US006286604B1

(12) United States Patent
Ou

(10) Patent No.: US 6,286,604 B1
(45) Date of Patent: Sep. 11, 2001

(54) POWERLESS AUTOMATIC AND/OR MANUAL FIRE-EXTINGUISHING DEVICE

(76) Inventor: Ren-Sheng Ou, 4F, No. 62, Sec. 2, Hsin Lung Rd., Taipei (TW)

( * ) Notice: Subject to any disclaimer, the term of this patent is extended or adjusted under 35 U.S.C. 154(b) by 0 days.

(21) Appl. No.: 09/566,996

(22) Filed: May 9, 2000

(51) Int. Cl.[7] ..... A62C 37/00; A62C 37/36; A62C 13/62

(52) U.S. Cl. ..... 169/56; 169/42; 169/65

(58) Field of Search ..... 169/56, 42, 48.5, 169/65, 16, 37, 41, 51; 239/209, 600

(56) References Cited

U.S. PATENT DOCUMENTS 1,085,805 * 2/1914 Erwin ..... 169/56
3,799,271 * 3/1974 Mitchell et al. ..... 169/16
4,979,572 * 12/1990 Mikulec ..... 169/56
5,297,636 * 3/1994 North ..... 169/65
5,645,128 * 7/1997 Schwall ..... 169/42
6,123,154 * 9/2000 MacDonald, III et al. ..... 169/37

* cited by examiner

*Primary Examiner*—David A. Scherbel
*Assistant Examiner*—Davis Hwu
(74) *Attorney, Agent, or Firm*—Varndell & Varndell, PLLC

(57) ABSTRACT

A powerless automatic and/or manual fire-extinguishing device is disclosed, which is especially a powerless fire-extinguishing device, wherein steel ropes are used to actuate a fire-extinguisher automatically or manually so that fire-extinguishing material can extinguish fire through fire-extinguishing tubes. The powerless automatic and/or manual fire-extinguishing device includes an automatic sensor and/or manual device, a fire-extinguisher steel barrel actuating device and a gas isolating device. In the automatic sensor or manual device, a fuse sensor or a manual switch is used so that the tightness of the steel rope is varied for actuating the actuating device of a fire-extinguisher steel barrel and the gas isolating device can be driven synchronously for isolating the supply of gas. Therefore, fire is extinguished and gas flow is closed.

14 Claims, 14 Drawing Sheets

POWERLESS AUTOMATIC AND/OR MANUAL FIRE-EXTINGUISHING DEVICE

FIELD OF THE INVENTION

The present invention relates to a powerless automatic and/or manual fire-extinguishing device, and especially to a powerless fire-extinguishing device, in which steel ropes are used to actuate a fire-extinguisher automatically or manually so that fire-extinguishing material can extinguish fire through fire-extinguishing tubes.

BACKGROUND OF THE INVENTION

The prior art fire-extinguishing structure is arranged according to the steel frames, and the smoke or high temperature sensor is exposed outsides for detecting smoke or temperature. A circuit control is used to a fire-extinguisher to actuate automatically. However, in fire accident, often power can not be supplied normally, and thus, the use of the device is not ideal. Moreover, in the prior art designs, a powerless fire-extinguishing device using steel ropes is used, while in that, the sensors and steel frames are exposed outsides and can not be enclosed. Furthermore, the steel ropes are arranged along a floor or beams so as to bent vertically. The work is hard, and thus the beauty of the room will be destroyed and it is not suitable to be used in bedroom, parlour, or cartridge with beautiful decoration.

SUMMARY OF THE INVENTION

Accordingly, the primary object of the present invention is to provide a powerless automatic and/or manual fire-extinguishing device comprising at least one fuse sensor, a plurality of adaptor, a steel rope and an automatic actuating device of a fire-extinguisher. In the automatic sensor or manual device, a fuse sensor or a manual switch is used so that the tightness of the steel rope is varied for actuating the actuating device of a fire-extinguisher steel barrel and the gas isolating device can be driven synchronously for isolating the supply of gas. Therefore, fire is extinguished and gas flow is closed.

Another object of the present invention is to provide a powerless automatic and/or manual fire-extinguishing device, wherein the fuse sensor is supported on the V shape fixing frame. A fuse pin serves to press a steel rope to be in a standby condition. In a high temperature from a fire accident, the fuse pin will break automatically so that the steel rope is in a release condition so as to actuate a fire-extinguisher. In the whole structure, only the fuse sensor is exposed, while the other components are shielded in the ceiling. Thus, the present invention has wide application, which is especially suitable in the bedroom, or cartridge, etc with decoration.

A further object of the present invention is to provide a powerless automatic and/or manual fire-extinguishing device, wherein the adaptor serves to be penetrated by the steel rope and change direction as desired. Thus, the steel rope can be installed conveniently according to the installing place without being confined by the terrain of the floor and beam.

The various objects and advantages of the present invention will be more readily understood from the following detailed description when reading in conjunction with the appended drawing.

DETAILED DESCRIPTION OF THE PREFERRED EMBODIMENTS

Figure 1:
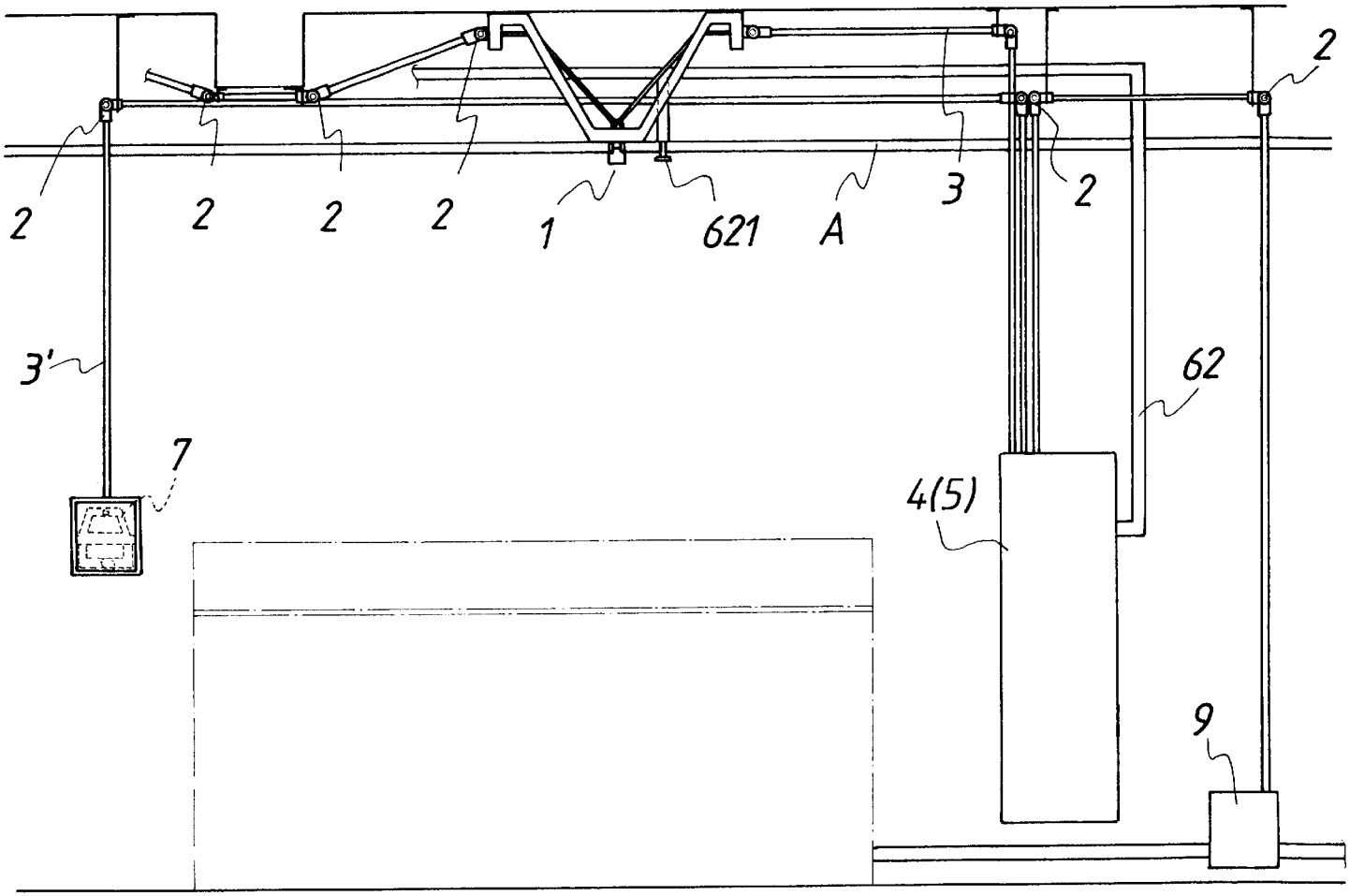
FIG. 1 shows one embodiment of the present invention.
Figure 2:
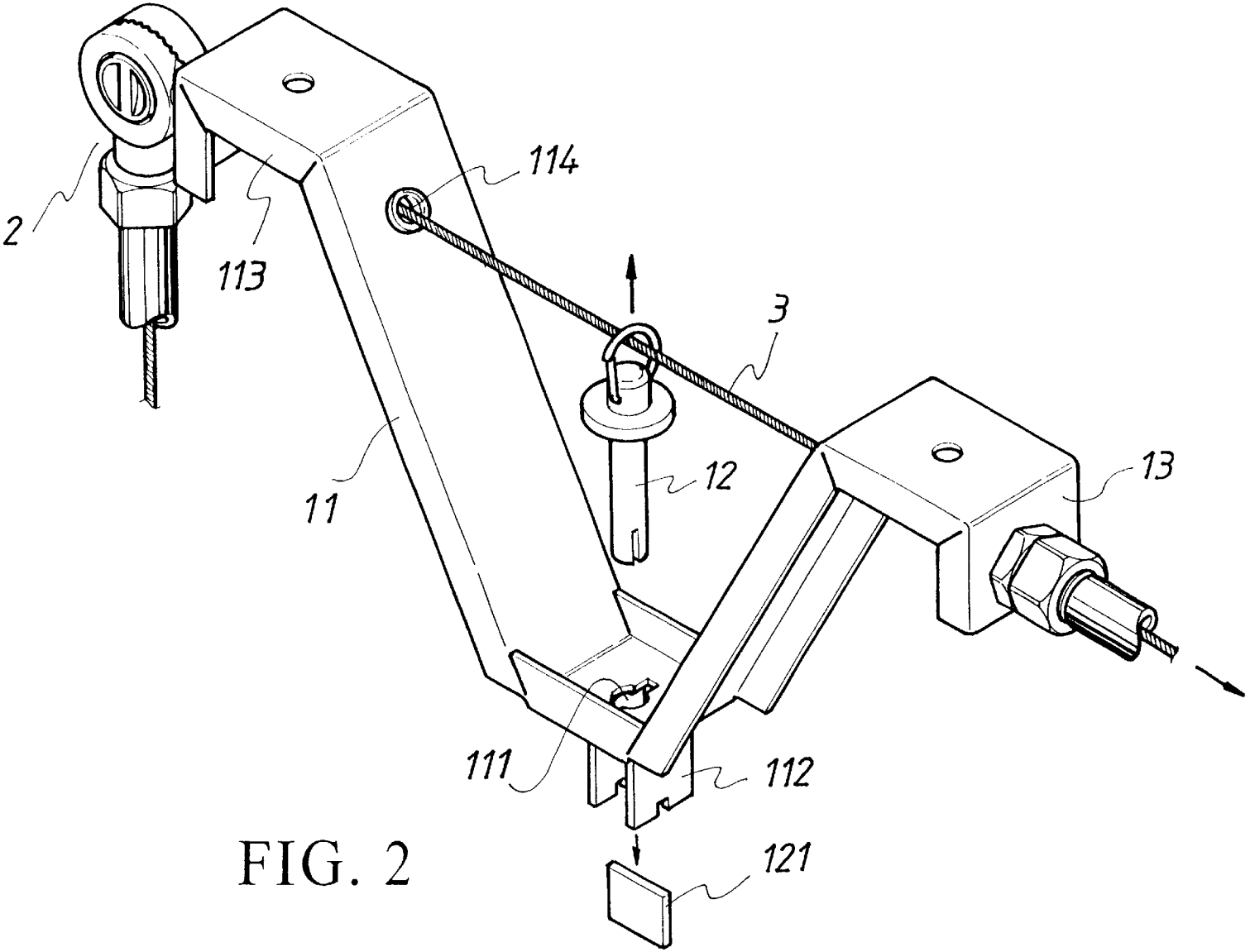
FIG. 2 is an exploded perspective view of the fuse sensor according to the present invention.

With reference to FIG. 1, the powerless automatic and/or manual fire-extinguishing device of the present invention is illustrated. The powerless automatic and/or manual fire-extinguishing device includes a fuse sensor 1, a plurality of adaptors 2, a steel rope 3 and an automatic actuating device 4 of a fire-extinguisher.

Figure 3:
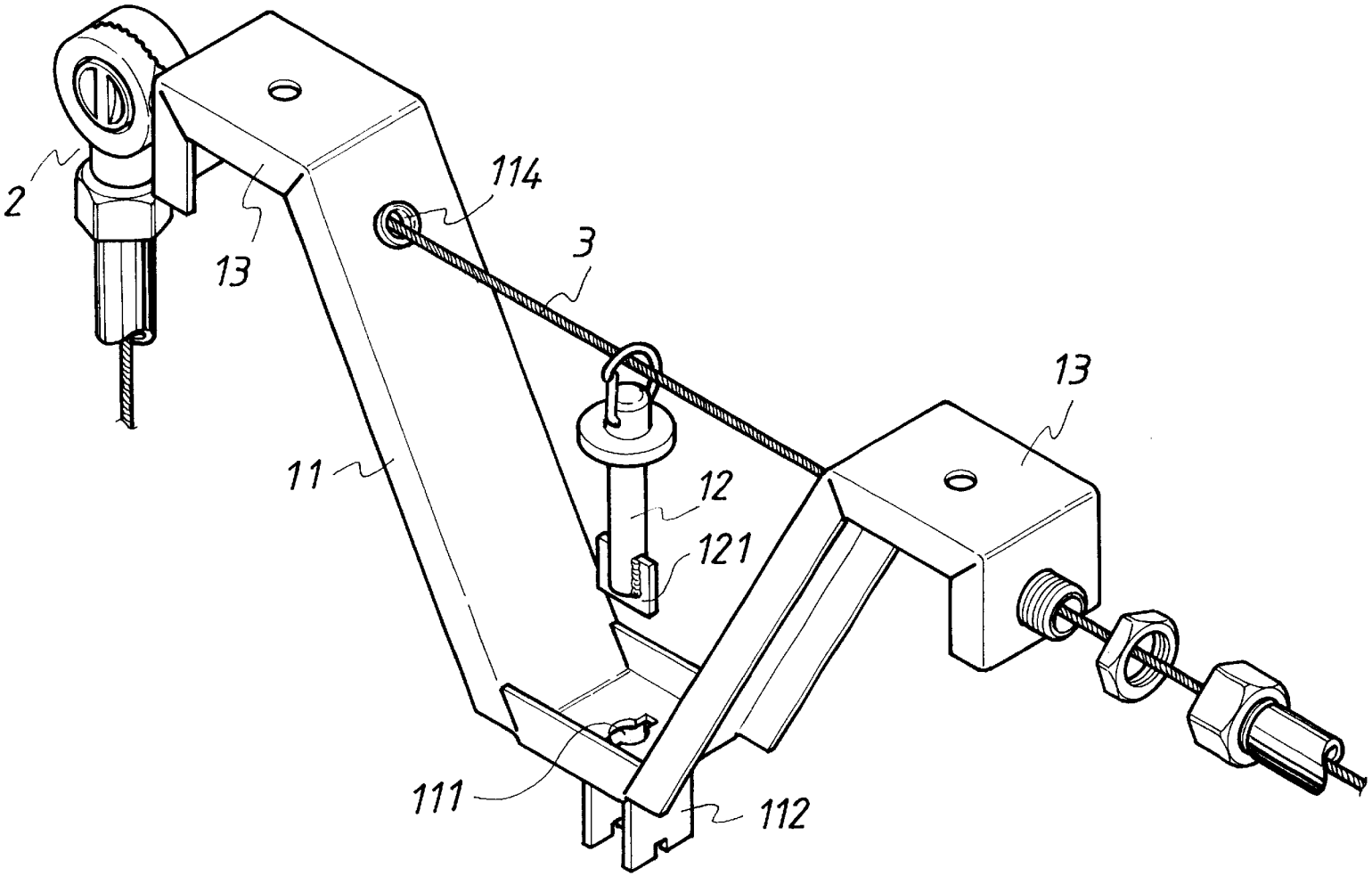
FIG. 3 is an assembled perspective view of the fuse sensor according to the present invention.
Figure 4:
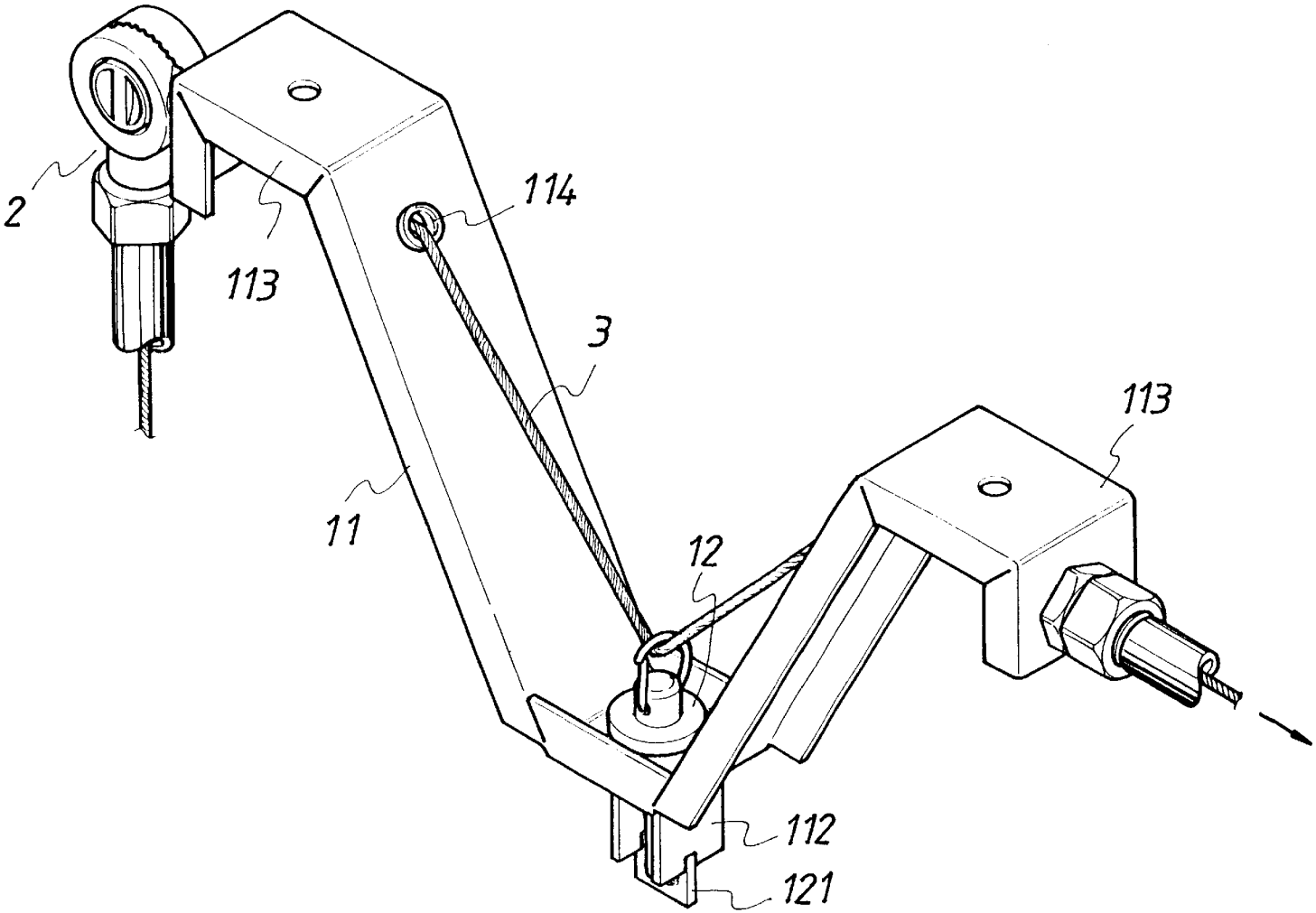
FIG. 4 is a schematic view showing that the fuse sensor of the present invention is pressed to be in a standby state.

As shown in FIGS. 1 to 4, the fuse sensor 1 is formed by a fixing frame 11 having a V shape or the like and a fuse pin 12. One or two sides thereof have an extending piece 113 and a through hole 114 for being penetrated by the steel rope 3. The fuse pin 12 has an upper end hung on the steel rope 3. The lower end thereof is welded with a pin plate 121 (as shown in FIG. 3) and is embedded into the opening 111 at the bottom of the fixing frame 11 to be buckled at the lower side of the stopper 112. In buckling, the steel rope 3 tightly presses downwards to be in a standby state (as shown in FIG. 4).

Figure 5:
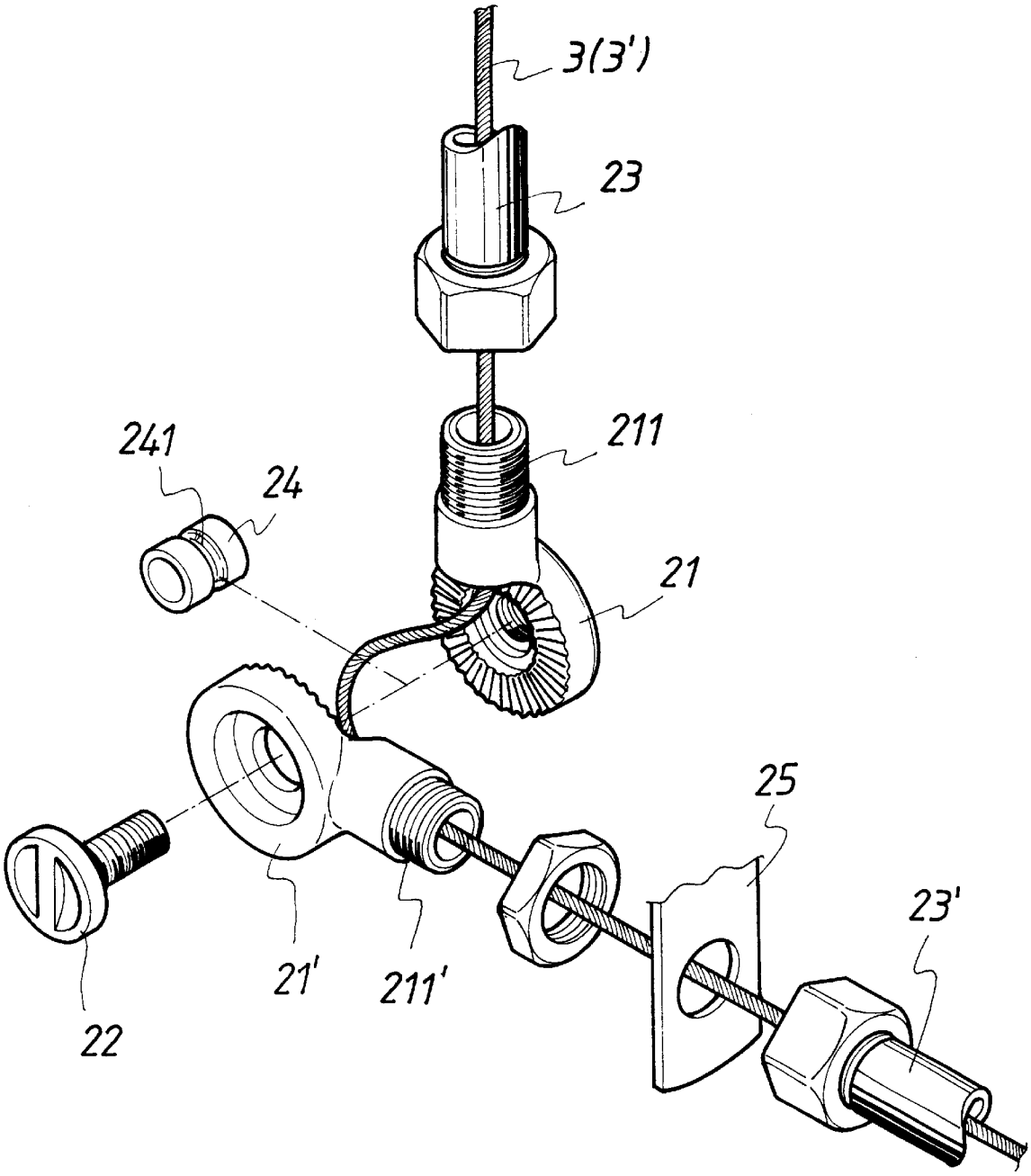
FIG. 5 is an exploded perspective view of the adaptor in the present invention.

The adaptor 2 is arranged according to the configuration of the floor, or beam, or ceiling A (as shown in FIG. 1) so that the steel rope 3 may penetrate through the adaptor 2 to be distributed on the floor or beam as desired. As shown in FIG. 5, the adaptor 2 is formed by two correspondingly engaged ratchets 21 and 21', a stud 22 and two hollow locking elements 23 and 23'.

One side of each ratchet 21, 21' is extended with a hollow locking tube 211 and 211' for being locking by the hollow locking elements 23, 23', the central portion thereof is a hollow stepped portion for receiving a hollow sliding shaft 24 and is fixed by the stud 22. Thus, the sliding shaft 24 is movably received therein. Moreover, the sliding shaft 24 has a round trench 241 so that the steel rope 3 sequentially penetrates through the hollow locking element 23 and the ratchet 21 and then changing direction through e round trench 241 of the sliding shaft 24 to rightwards pass out the hollow locking tube 211' and the hollow locking element 24' of another ratchet disk 21'.

If the aforesaid adaptors 2 are properly secured to a floor or beams, one end of a fixing piece 25 is in advance fixed to the floor or the beams, while another end passes through the space between the hollow locking tubes 211 or 211' installed in the ratchets 21 or 21' and the hollow locking elements 23 and 24' for locking.

The steel ropes 3 and 3' are distributed as desired. The installing place is installed with one or more fuse sensor 1, a plurality of adaptors 2 and a fire extinguisher automatic actuating device 4 and/or a manual fire extinguisher device 5.

Figure 6:
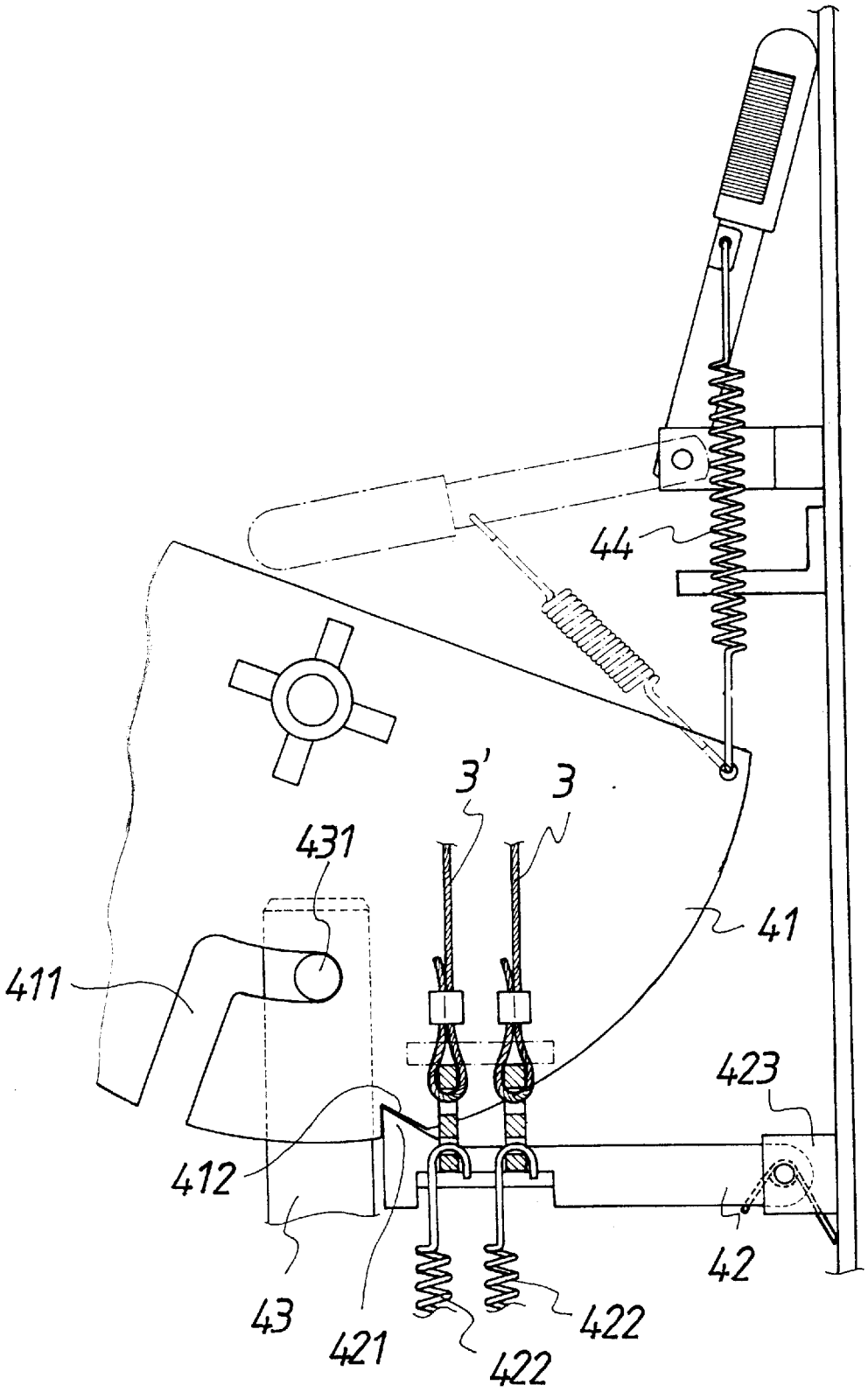
FIG. 6 is an assembled schematic view of the automatic actuating device of the present invention.
Figure 7:
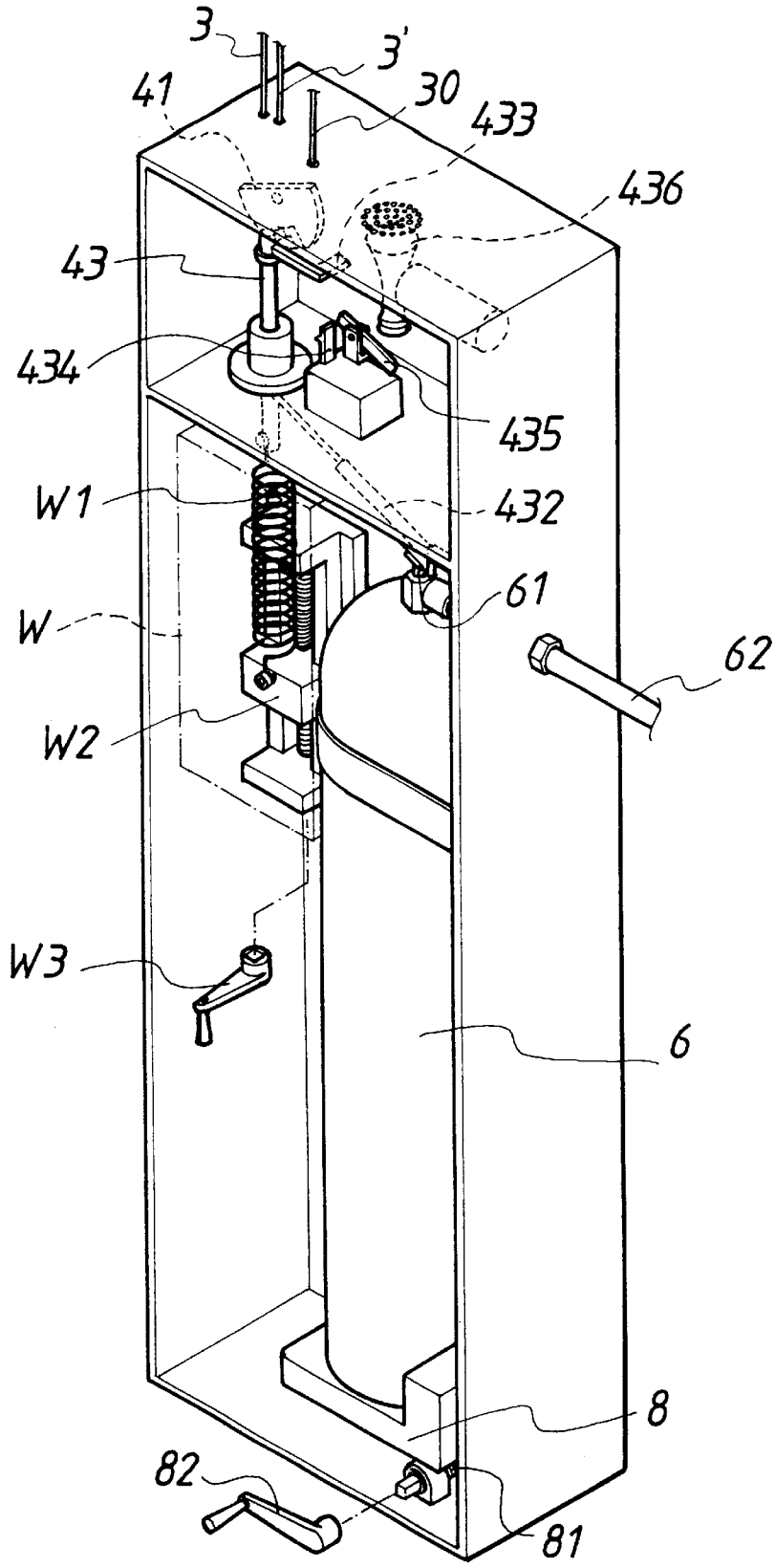
FIG. 7 is an assembled perspective view of the actuating device according to the present invention.
Figure 8:
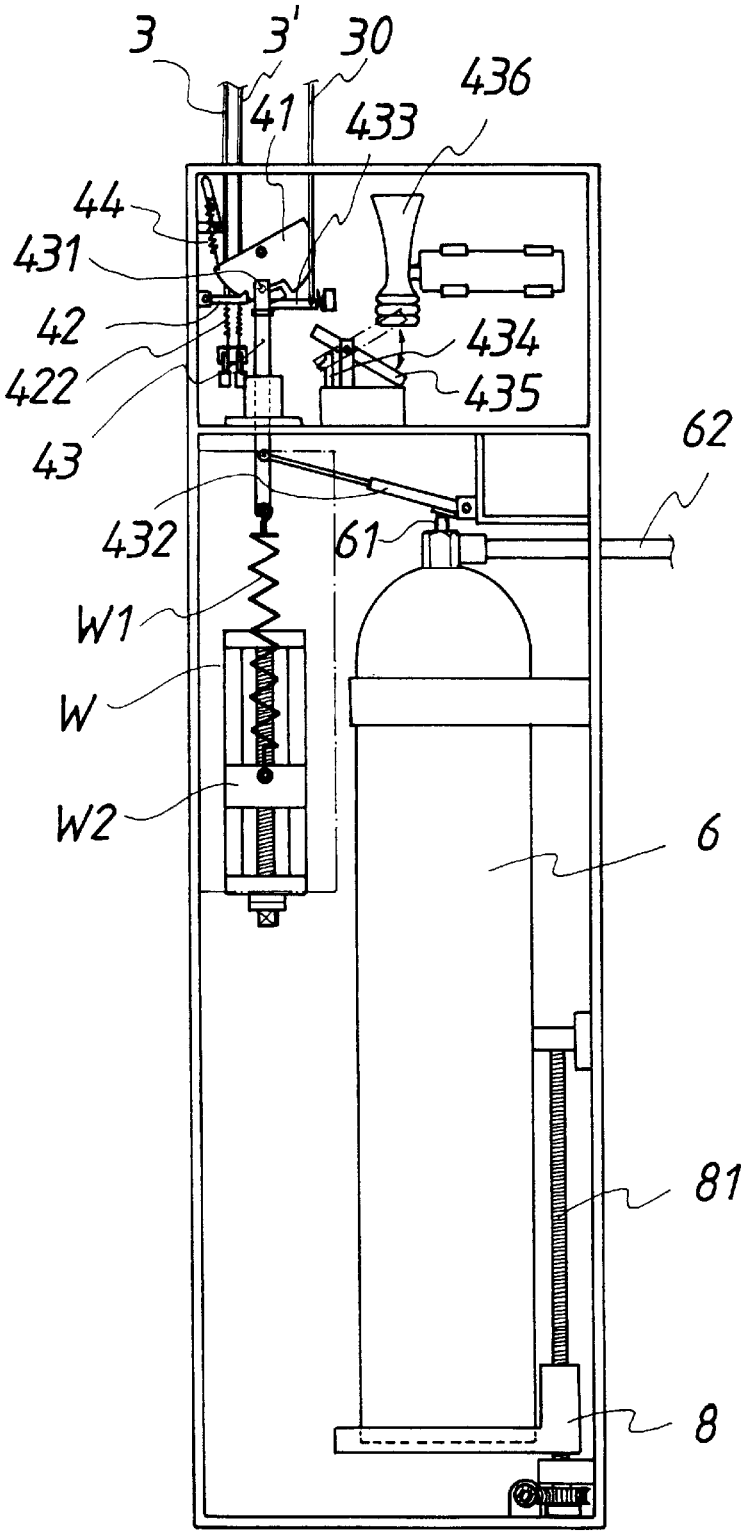
FIG. 8 is an arrangement schematic view of the actuating device according to the present invention.

As shown in FIGS. 6 to 8, The automatic actuating device 4 includes a swingable rod 41, an actuating rod 41, a stopping pin 43 and an elastic element 44.

Figure 9:
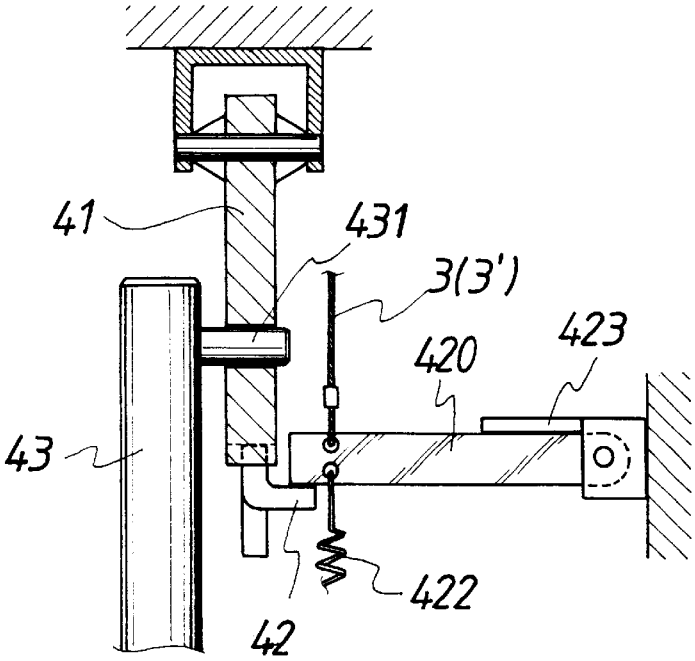
FIG. 9 is an arrangement schematic view of the actuating rod and the steel rope according to the present invention.
Figure 10:
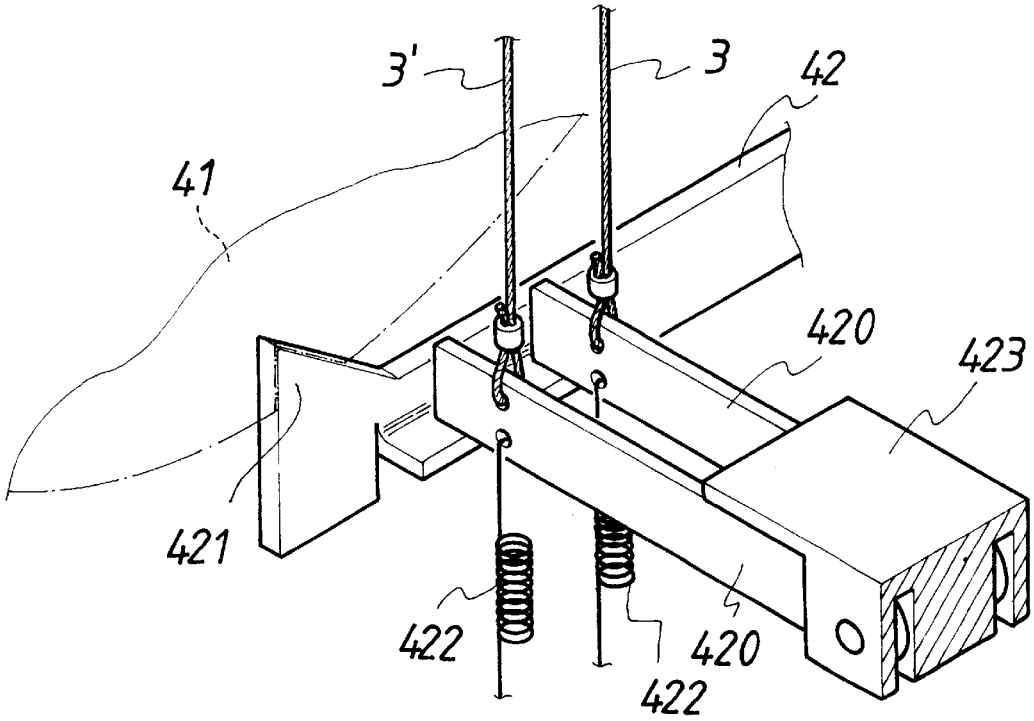
FIG. 10 is an arrangement perspective view of the actuating rod and the steel rope according to the present invention.
Figure 11:
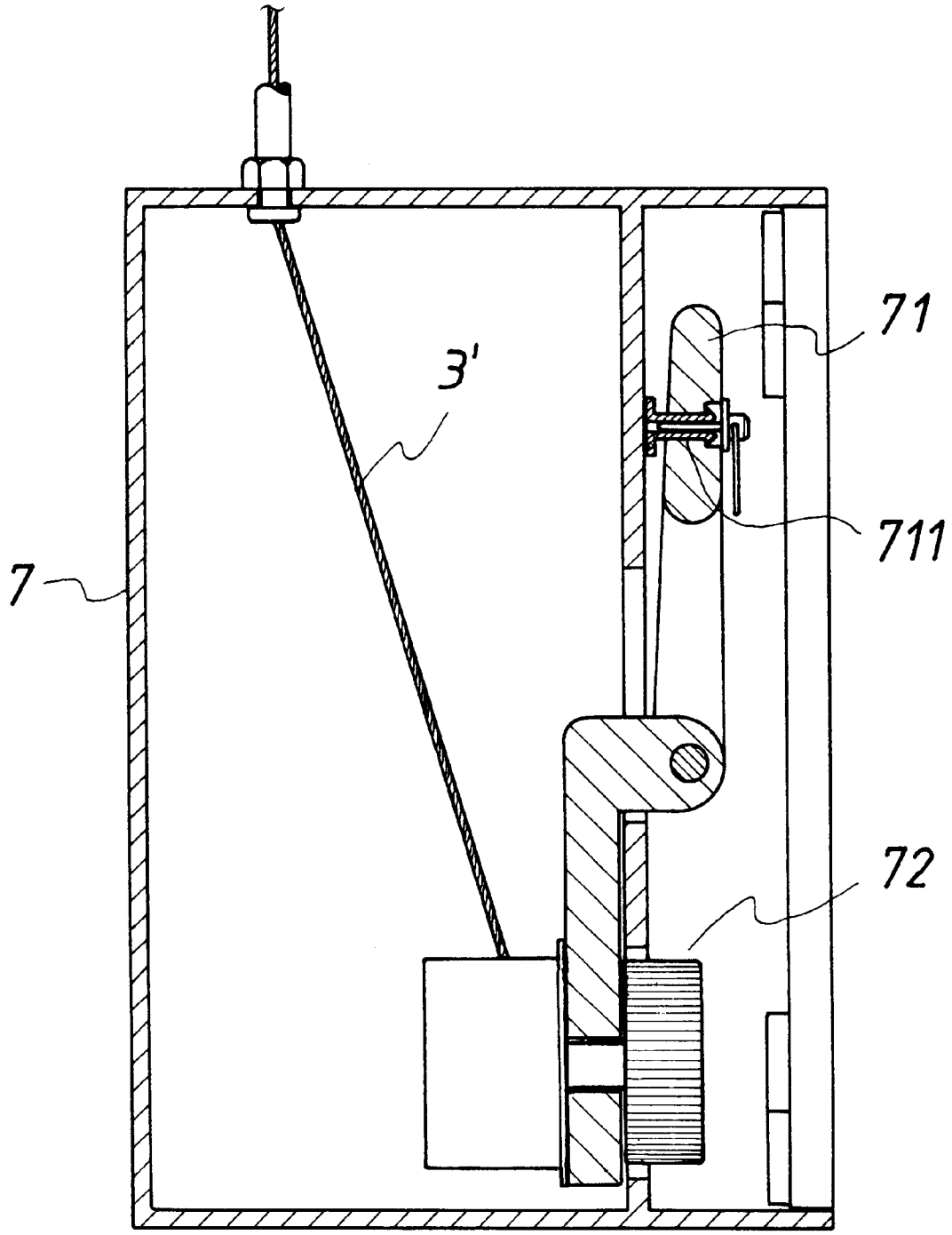
FIG. 11 is an arrangement schematic view of the manual actuating device according to the present invention.

The actuating rod 42, as shown in FIGS. 9 and 10, is positioned by suspending a movable rod 420 through the automatic actuating and/or manual actuating steel ropes 3, 3' and resisting one end thereof against a top plate 423. The front end of the actuating rod 42 has a protrusion 421 capable of embedding into the groove 412 of the swingable rod 41 and the lower end thereof is pulled and fixed by the telescopic spring 422. When any one of the automatic actuating steel rope 3 or manual actuating steel rope 3' is released, the actuating rod 42 will fall down to be released from the buckling of the swingable rod 42.

The stopping pin 43 is a pin body, and the front end thereof is a vertical pin rod 431. The vertical pin rod 431 inserts into the L shape buckling groove 411 of the swingable plate 41 and is buckled therein. However, as the swingable plate 41 is shifted, the stopping pin 43 can be released. Further, as shown in FIGS. 7 and 8, the lower end of the stopping pin 43 suspends with a weigh or an acting force W. While the middle section is connected to a pressing rod 432. As the stopping pin 43 moves downwards, the pressing rod 432 will be driven to press the switch 61 of the steel barrel 6 of the fire extinguisher so that the fire extinguisher releases fire-extinguishing material. Then, by the fire-extinguishing tube 62, the fire-extinguishing material arrives at the outlets 621 of the tube for fire-extinguishing.

The manual fire-extinguishing device 5 includes a manual actuating steel rope 3' and a manual opening device 7. The manual actuating steel rope 3' is arranged independently from the automatic actuating steel rope 3, and one end thereof is connected to the stopping pin 43 for generating an actuating function independently, while another end is connected to the manual opening device 7. When the manual actuating device 7 is actuated, the steel rope 3 will release to cause the stopping pin 43 moves downwards slowly to drive the pressing rod 432 presses the switch 61 of the fire-extinguisher steel barrel 6 for fire-extinguishing.

Figure 12:
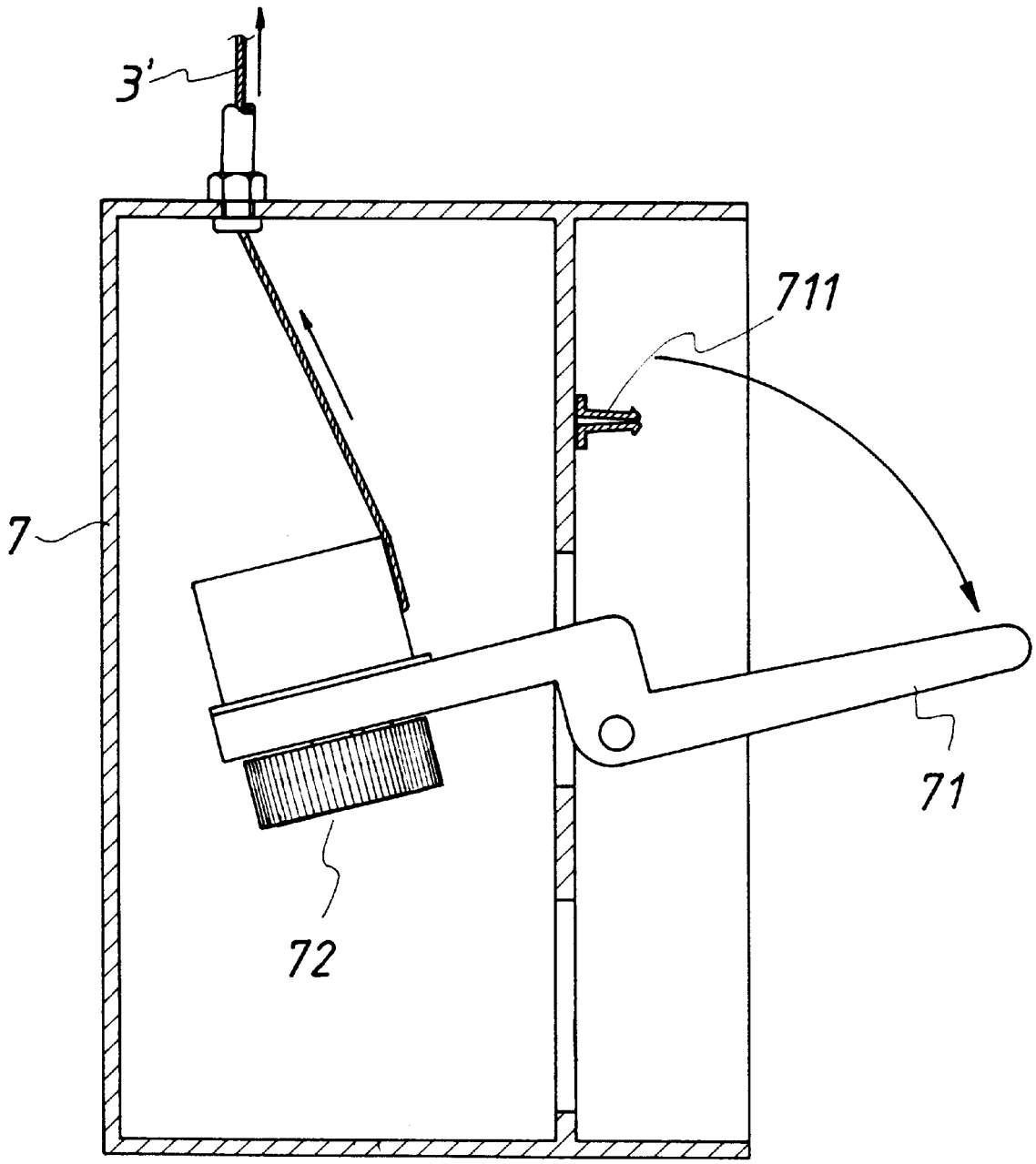
FIG. 12 is an arrangement schematic view of the opened manual actuating device according to the present invention.
Figure 13:
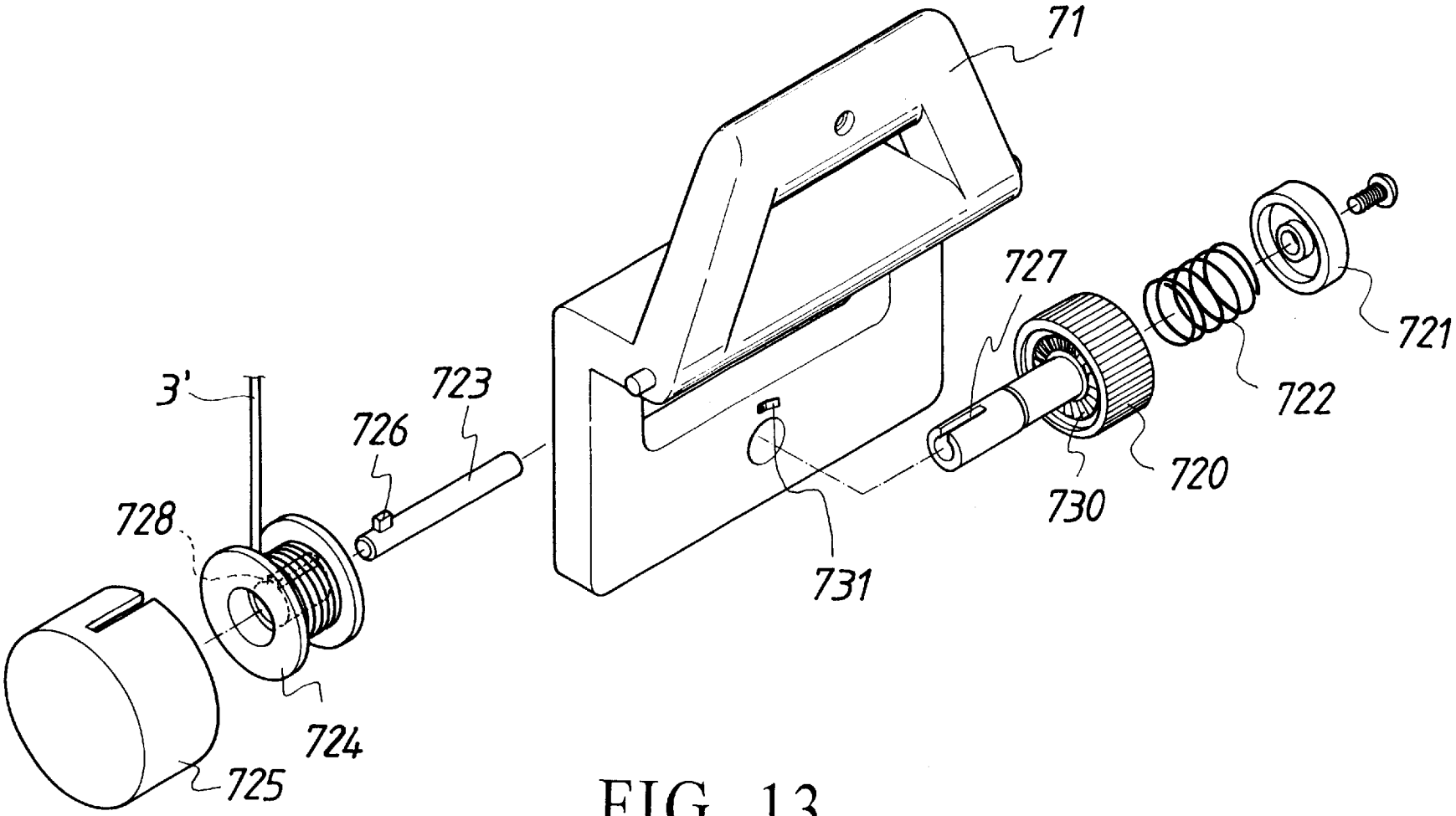
FIG. 13 is an exploded perspective view of the exploded perspective view of the braking handle of the present invention.
Figure 14:
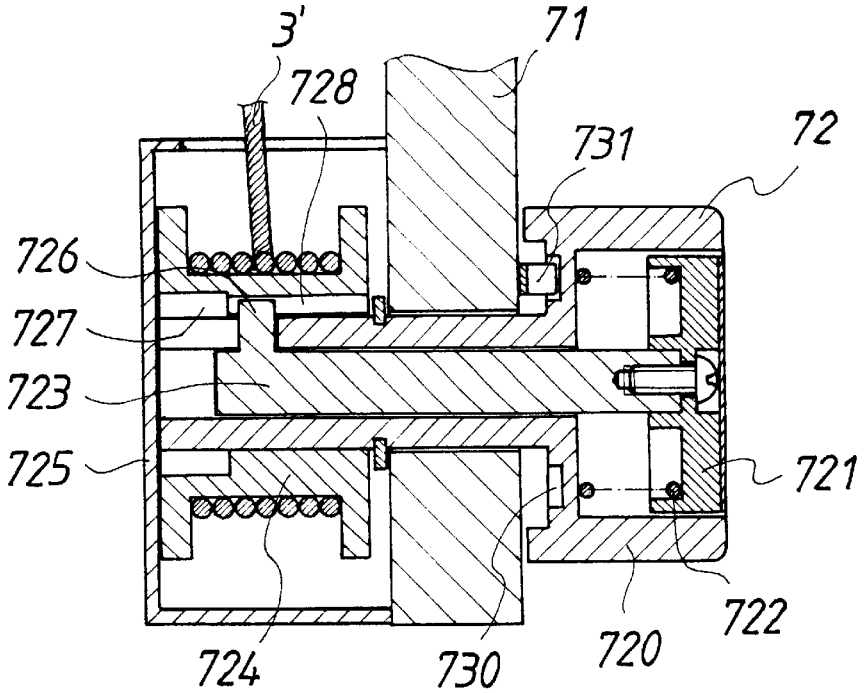
FIG. 14 is an assembled schematic view of the pressure releasing device in the present invention.
Figure 15:
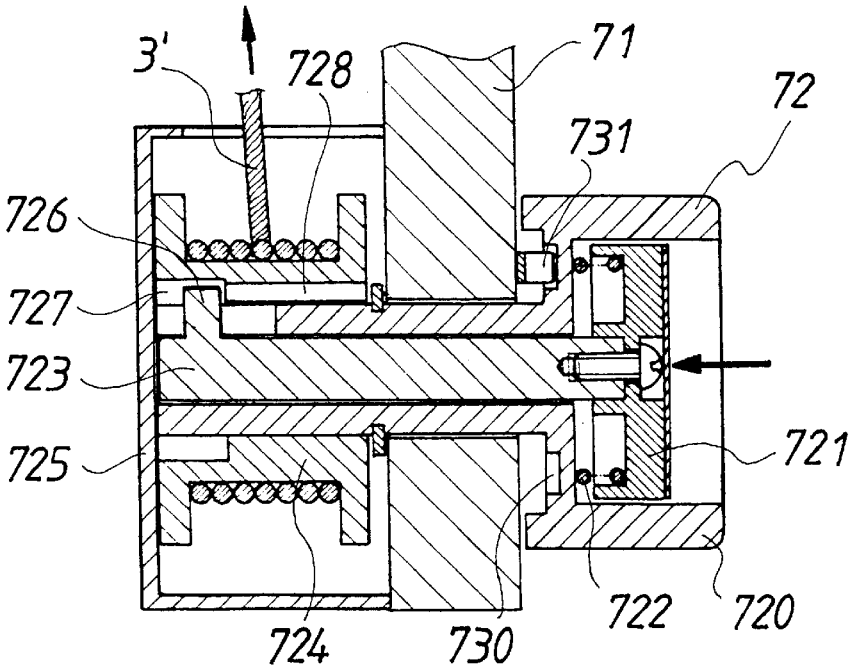
FIG. 15 is a schematic view showing that the pressure releasing device of the present invention is opened.

Referring to FIGS. 11 to 15, the manual opening device 7 includes a braking handle 71 and a pressure releasing device 72 appending to the body of the breaking handle 7. In general, the braking handle 71 is fixed through a safety pin 711. As desired, the safety pin 711 can be removed so that the braking handle 71 is movable to cause that the manual actuating steel rope 3' is in a loose condition (as shown in FIG. 12). The pressure release device 72 is formed by a supporting seat 720, a button 721, a spring 722, a pin body 723, a releasing wheel 724, and a bottom case 725. The button 721 and the spring 722 are embedded into and movable locks the supporting seat 720. The pin body 723 is embedded in the releasing wheel 724, and one end thereof is locked to the button 721. The front ends of the pin body 723 and the supporting seat 720 have a key block 726 and a trench 727, respectively. A key groove 728 is installed within the releasing wheel 724. As the button 721 is pressed, the key block 728 will separate from the key groove 728 so as to rotate the releasing wheel 724. Thus, the manual actuating steel rope 3' is released (as shown in FIG. 5). Therefore, a user can select the breaking handle 71 or the pressure releasing device 72 as a manual opening way.

Furthermore, in the aforesaid pressure releasing device 72, the inner wall of the supporting seat 720 has a plurality of teeth 730 arranged as a ring shape. The circular plurality of teeth 730 is engaged with respect to the protrusion 731 of the body of the braking handle 71, and thus, the supporting seat 720 may rotate for driving the pressure releasing wheel 724 so as to tighten the steel rope 3'. However, as rotating in a reverse direction, the supporting seat 720 can not rotate.

As shown in FIGS. 7 and 8, the weight hung from or force W applied to the lower end of the stopping pin 43 can be formed by the spring W1 and a movable seat W2. The spring W1 displaces with the traveling of the movable seat W2 so that the force W is varied. The moving of the movable seat W2 can be controlled by the driving handle W3.

Next, for the positioning of the fire-extinguisher steel barrel 6, since the sizes of the steel barrels are different, in order to assure as the stopping pin 43 moves downwards, it will slowly press downwards to drive the pressing rod 432 to open the switch 61 of the fire-extinguisher steel barrel 6 successfully. Moreover, a supporting plate 8 movably in the longitudinal direction is installed at the lower end of the fire-extinguisher steel barrel 6. A helical rod 81 can be installed at the lower end of the supporting plate 8 and rotate by a driving handle 82 so that the supporting seat 8 freely moves.

As shown in FIGS. 7 and 8, one side of the stopping pin 43 is installed with an L shape supporting rod 433 at one side of the stopping pin 43 will be buckled immediately for preventing the stopping pin 43 from vibration due to supporting rod 433, and a buckling plate 434 is placed at a selected place so that as the stopping pin 43 moves downwards due to the instant releasing of the steel rope 3 or 3' so as to affect the precision of the actuation of the fire-extinguisher steel barrel 6. Further, at one side of the aforesaid plate can be installed with swingable rod 435 which is exactly aligned to the trigger position of a high pressure trumpet 436. When the stopping pin 43 moves downwards, the swingable rod 435 will move upwards. Thus, in a powerless condition, the high pressure trumpet 436 can be triggered to emit an alarm voice.

Figure 16:
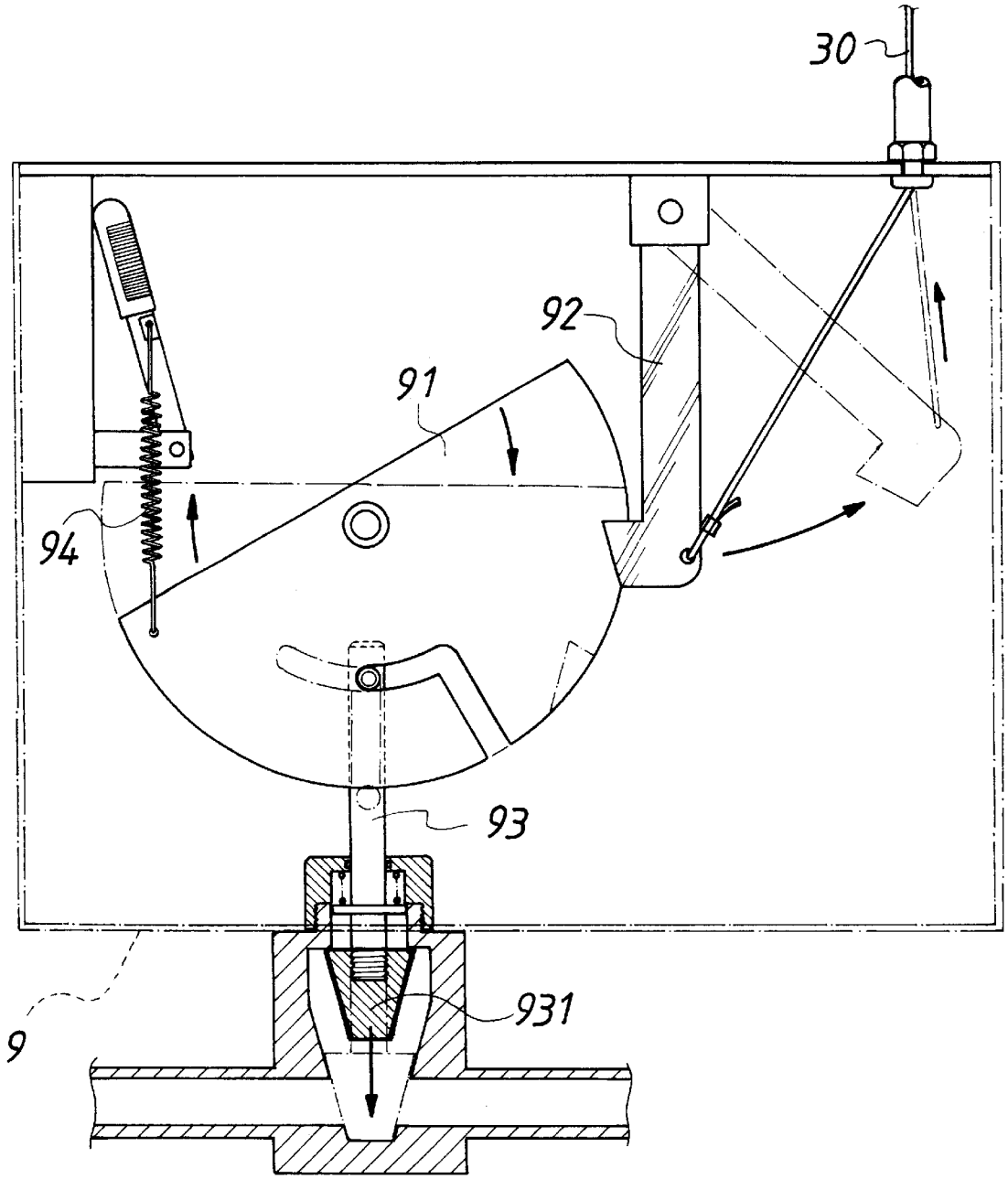
FIG. 16 is an assembled schematic view of the gas isolation device of the present invention.

According to FIG. 16, one side of the stopping pin 32 is arranged with an L shape supporting rod 433, which can be firmly secured with a third steel rope 30 so as to be connected to a gas isolation device 9. The basic structure of the gas isolation device 9 is identical to the automatic actuating device 4 and includes a swingable plate 91, an actuating rod 92, a stopping pin 93, and an elastic element 94. As the third steel rope 93 is pulled, the swingable plate 91 will be released so as to isolate the gas flow by the closing valve 931 in the front end of the stopping pin 93. Hence, the object of fire-extinguishing is achieved.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A powerless automatic and/or manual fire-extinguishing device comprising at least one fuse sensor, a plurality of adaptors, a steel rope and an automatic actuating device of a fire-extinguisher, wherein:

the fuse sensor is formed by a fixing frame and a fuse pin, a lower end of the fixing frame is installed with an opening and a stopper, one or two sides thereof have an extending piece and a through hole for being penetrated by the steel rope; the fuse pin has an upper end hung on the steel rope and the lower end thereof is welded with a pin plate and is embedded into the opening at a bottom of the fixing frame to be buckled at a lower side of the stopper; in buckling, the steel rope tightly presses downwards to be in a standby state; as the fuse pin is melted, the fuse sensor will act;

the adaptor is arranged according to a configuration of a floor, or beam so that the steel rope can penetrate therethrough; the steel ropes are distributed as desired; an installing place is installed with one or more fuse sensor, a plurality of adaptor and a fire extinguisher automatic actuating device and/or a manual fire extinguisher device; by variations of the steel rope, the fire extinguisher automatic actuating device and/or a manual fire extinguisher device on a steel barrel of fire-extinguisher are controlled, or a gas isolation device can be driven for isolating the gas flow;

the automatic actuating device is a switch for switching the signal input end of steel barrel so that the fire-extinguisher releases fire-extinguishing material, and then passes through a fire-extinguishing tube to flow to at least one outlet for fire-extinguishing; and the manual fire-extinguishing device includes a manual actuating steel rope independently arranged and a manual opening device for actuation independently so that the independent steel rope looses and then opens the switch of the fire-extinguisher steel barrel by pressure.

2. The powerless automatic and/or manual fire-extinguishing device as claimed in claim 1, wherein the fixing frame of the fuse sensor has a V shape or other similar shapes.

3. A powerless automatic and/or manual fire-extinguishing device comprising at least one fuse sensor, a plurality of adaptors, a steel rope and an automatic actuating device of a fire-extinguisher, wherein:

the fuse sensor is formed by a fixing frame and a fuse pin; the steel rope tightly presses downwards by the fuse pin to be in a standby state; as the fuse pin is melted, the fuse sensor will act;

the adaptor is arranged according to a configuration of a floor, or beam so that the steel rope can penetrate therethrough; the steel ropes are distributed as desired; an installing place is installed with one or more fuse sensor, a plurality of adaptor and a fire extinguisher automatic actuating device and/or a manual fire extinguisher device; by variations of the steel rope, the fire extinguisher automatic actuating device and/or a manual fire extinguisher device on a steel barrel of fire-extinguisher are controlled, or a gas isolation device can be driven for isolating the gas flow; the adaptor is formed by two correspondingly engaged ratchets, a stud and two hollow locking elements; one side of each ratchet is extended with a hollow locking tube for being locking by the hollow locking elements, the central portion thereof is a hollow stepped portion for receiving a hollow sliding shaft and is fixed by the stud; thus, the sliding shaft is movably received therein; the sliding shaft has a round trench so that the steel rope sequentially penetrates through the hollow locking element and the ratchet and then changing direction through the round trench of the sliding shaft to pass out of the hollow locking tube and the hollow locking element of another ratchet disk the automatic actuating device is a switch for switching the signal input end of steel barrel so that the fire-extinguisher releases fire-extinguishing material, and then passes through a fire-extinguishing tube to flow to at least one outlet for fire-extinguishing; and the manual fire-extinguishing device includes a manual actuating steel rope independently arranged and a manual opening device for actuation independently so that the independent steel rope looses and then opens the switch of the fire-extinguisher steel barrel by pressure.

4. The powerless automatic and/or manual fire-extinguishing device as claimed in claim 3, wherein one end of a fixing piece is in advance fixed to the floor or the beam by the adaptor, while another end passes through the space between the hollow locking tubes installed in the ratchets and the hollow locking elements for locking.

5. A powerless automatic and/or manual fire-extinguishing device comprising at least one fuse sensor, a plurality of adaptors, a steel rope and an automatic actuating device of a fire-extinguisher, wherein:

the fuse sensor is formed by a fixing frame and a fuse pin; the steel rope tightly presses downwards by the fuse pin to be in a standby state; as the fuse pin is melted, the fuse sensor will act;

the adaptor is arranged according to a configuration of a floor, or beam so that the steel rope can penetrate therethrough; the steel ropes are distributed as desired; an installing place is installed with one or more fuse sensor, a plurality of adaptor and a fire extinguisher automatic actuating device and/or a manual fire extinguisher device; by variations of the steel rope, the fire extinguisher automatic actuating device and/or a manual fire extinguisher device on a steel barrel of fire-extinguisher are controlled, or a gas isolation device can be driven for isolating the gas flow;

the automatic actuating device is a switch for switching the signal input end of steel barrel so that the fire-extinguisher releases fire-extinguishing material, and then passes through a fire-extinguishing tube to flow to at least one outlet for fire-extinguishing; the automatic actuating device includes a swingable rod, an actuating rod, a stopping pin and an elastic element;

the swingable rod is movably and pivotally installed in a selected position, and an L shape buckling groove and a groove are installed at selected positions;

the actuating rod is positioned by suspending a movable rod through the automatic actuating and/or manual actuating steel ropes and resisting one end thereof against a top plate; the front end of the actuating rod has a protrusion capable of embedding into the groove of the swingable rod and a lower end thereof is pulled and fixed by the telescopic spring; when any one of the automatic actuating steel rope or manual actuating steel rope is released, the actuating rod will fall down to be released from the buckling of the swingable rod;

the stopping pin is a pin body, and the front end thereof is a vertical pin rod; the vertical pin rod inserts into the L shape buckling groove of the swingable plate and is buckled therein; when the swingable plate is shifted, the stopping pin is released; and the manual fire-extinguishing device includes a manual actuating steel rope independently arranged and a manual opening device for actuation independently so that the independent steel rope looses and then opens the switch of the fire-extinguisher steel barrel by pressure.

6. The powerless automatic and/or manual fire-extinguishing device as claimed in claim 5, wherein a lower end of the stopping pin suspends with a weight or an action force; the middle section is connected to a pressing rod; as the stopping pin moves downwards, the pressing rod will be driven to press the switch of the steel barrel of the fire extinguisher.

7. The powerless automatic and/or manual fire-extinguishing device as claimed in claim 5, wherein the weight hung from or the force applied to the lower end of the stopping pin is formed by the spring and a movable seat;b the spring displaces with the traveling of the movable seat so that the force is varied; the moving of the movable seat is controlled by a driving handle through a helical rod.

8. The powerless automatic and/or manual fire-extinguishing device as claimed in claim 5, wherein one side of the stopping pin is installed with an L shape supporting rod, and a buckling plate is placed at a selected place so that as the stopping pin moves downwards, it is a buckled effect with the L shape supporting rod at one side of the stopping pin.

9. The powerless automatic and/or manual fire-extinguishing device as claimed in claim 8, wherein at one side of the plate is installed with swingable rod which is exactly aligned to the trigger position of a high pressure trumpet; as the stopping moves downwards, the swingable rod will move upwards, thus, the high pressure trumpet is triggered to emit an alarm voice.

10. The powerless automatic and/or manual fire-extinguishing device as claimed in claim 5, wherein one side of the stopping pin is arranged with an L shape supporting rod, which can be firmly secured with a third steel rope so as to be connected to a gas isolation device; the gas isolation device includes a swingable plate1, an actuating rod, a stopping pin, and an elastic element; as the third steel rope is pulled, the swingable plate is released so as to isolate the gas by a closing valve in the front end of the stopping pin.

11. A powerless automatic and/or manual fire-extinguishing device comprising at least one fuse sensor, a plurality of adaptors, a steel rope and an automatic actuating device of a fire-extinguisher, wherein:

the fuse sensor is formed by a fixing frame and a fuse pin; the steel rope tightly presses downwards by the fuse pin to be in a standby state; as the fuse pin is melted, the fuse sensor will act;

the adaptor is arranged according to a configuration of a floor, or beam so that the steel rope can penetrate therethrough; the steel ropes are distributed as desired; an installing place is installed with one or more fuse sensor, a plurality of adaptor and a fire extinguisher automatic actuating device and/or a manual fire extinguisher device; by variations of the steel rope, the fire extinguisher automatic actuating device and/or a manual fire extinguisher device on a steel barrel of fire-extinguisher are controlled, or a gas isolation device can be driven for isolating the gas flow;

the automatic actuating device is a switch for switching the signal input end of steel barrel so that the fire-extinguisher releases fire-extinguishing material, and then passes through a fire-extinguishing tube to flow to at least one outlet for fire-extinguishing; and the manual fire-extinguishing device includes a manual actuating steel rope independently arranged and a manual opening device for actuation independently so that the independent steel rope looses and then opens the switch of the fire-extinguisher steel barrel by pressure; and the manual opening device of the manual fire-extinguishing device includes a braking handle and a pressure releasing device appending to the body of the breaking handle; in general, the braking handle is fixed through a safety pin; as desired, the safety pin is removed so that the braking handle is movable so that the manual actuating steel rope is in a loose condition.

12. The powerless automatic and/or manual fire-extinguishing device as claimed in claim 11, wherein the pressure release device is formed by a supporting seat, a button, a spring, a pin body, a releasing wheel, and a bottom case; the button and the spring are embedded into and movable locking the supporting seat; the pin body is embedded in the releasing wheel, and one end thereof is locked to the button; the front ends of the pin body and the supporting seat have a key block and a trench, respectively; a key groove is installed within the releasing wheel; as the button is pressed, the key block will separate from the key groove so as to rotate the releasing wheel; thus, the manual actuating steel rope is released.

13. The powerless automatic and/or manual fire-extinguishing device as claimed in claim 12, wherein an inner wall of the supporting seat has a plurality of teeth arranged as a ring shape; the circular plurality of teeth is engaged with respect to the protrusion of the body of the braking handle, and thus, the supporting seat rotates for driving the pressure releasing wheel so as to tighten the steel rope, while as rotating in a reverse direction, the supporting seat does not rotate.

14. A powerless automatic and/or manual fire-extinguishing device comprising at least one fuse sensor, a plurality of adaptors, a steel rope and an automatic actuating device of a fire-extinguisher, wherein:

the fuse sensor is formed by a fixing frame and a fuse pin; the steel rope tightly presses downwards by the fuse pin to be in a standby state; as the fuse pin is melted, the fuse sensor will act;

the adaptor is arranged according to a configuration of a floor, or beam so that the steel rope can penetrate therethrough; the steel ropes are distributed as desired; an installing place is installed with one or more fuse sensor, a plurality of adaptor and a fire extinguisher automatic actuating device and/or a manual fire extinguisher device; by variations of the steel rope, the fire extinguisher automatic actuating device and/or a manual fire extinguisher device on a steel barrel of fire-extinguisher are controlled, or a gas isolation device can be driven for isolating the gas flow;

the automatic actuating device is a switch for switching the signal input end of steel barrel so that the fire-extinguisher releases fire-extinguishing material, and then passes through a fire-extinguishing tube to flow to at least one outlet for fire-extinguishing;

the manual fire-extinguishing device includes a manual actuating steel rope independently arranged and a manual opening device for actuation independently so that the independent steel rope looses and then opens the switch of the fire-extinguisher steel barrel by pressure; and a supporting plate movably longitudinally is installed at the lower end of the fire-extinguisher steel barrel; a helical rod is installed at a lower end of the supporting plate and rotates by a driving handle so that the supporting seat freely moves.

* * * * *